US011043739B2

(12) United States Patent
Palud

(10) Patent No.: US 11,043,739 B2
(45) Date of Patent: Jun. 22, 2021

(54) COLLINEAR ANTENNA STRUCTURE WITH INDEPENDENT ACCESSES

(71) Applicant: TDF, Montrouge (FR)

(72) Inventor: Sébastien Palud, Rennes (FR)

(73) Assignee: TDF, Montrouge (FR)

( * ) Notice: Subject to any disclaimer, the term of this patent is extended or adjusted under 35 U.S.C. 154(b) by 0 days.

(21) Appl. No.: 16/619,217

(22) PCT Filed: Jun. 26, 2018

(86) PCT No.: PCT/FR2018/051559
§ 371 (c)(1),
(2) Date: Dec. 4, 2019

(87) PCT Pub. No.: WO2019/002752
PCT Pub. Date: Jan. 3, 2019

(65) Prior Publication Data

US 2020/0185825 A1 Jun. 11, 2020

(30) Foreign Application Priority Data

Jun. 26, 2017 (FR) ..... 1755843

(51) Int. Cl.

| | |
|---|---|
| ***H01Q 21/10*** | (2006.01) |
| ***H01Q 1/52*** | (2006.01) |
| ***H01Q 9/30*** | (2006.01) |
| *H01P 3/06* | (2006.01) |

(52) U.S. Cl.
CPC ..... *H01Q 1/521* (2013.01); *H01Q 9/30* (2013.01); *H01Q 21/10* (2013.01); *H01P 3/06* (2013.01)

(58) Field of Classification Search
None
See application file for complete search history.

(56) References Cited

U.S. PATENT DOCUMENTS 5,600,338 A * 2/1997 Ecklund ..... H01Q 1/16 343/790
5,963,168 A * 10/1999 Brennan ..... H01Q 21/10 343/700 MS (Continued)

FOREIGN PATENT DOCUMENTS

DE 1923334 11/1970

*Primary Examiner* — Vibol Tan
(74) *Attorney, Agent, or Firm* — Duane Morris LLP; Gregory M. Lefkowitz

(57) ABSTRACT

The invention relates to an antenna structure for transmitting and/or receiving wavelengths of metric frequency or decimetric frequency, characterised in that it comprises n collinear antennas, each antenna comprising a radiating portion comprising a first succession of i coaxial radiating elements about a first axis alternating with at least an additional succession of i radiating elements about another axis, each antenna being independently powered by a coaxial cable, each antenna comprising at least one lower quarter-wave trap and at least one upper quarter-wave trap, at least a first antenna comprising at least one hollow core being configured to receive a coaxial cable intended for powering of another antenna collinear with the first antenna, at least one intermediate quarter-wave trap being arranged between two consecutive collinear antennas around a coaxial cable, and a terminal element.

8 Claims, 6 Drawing Sheets

(56) References Cited

U.S. PATENT DOCUMENTS

| | | | | |
|---|---|---|---|---|
| 6,057,804 | A * | 5/2000 | Kaegebein | H01Q 9/32 343/790 |
| 6,836,256 | B2 * | 12/2004 | Hung | H01Q 9/16 343/715 |
| 6,947,006 | B2 * | 9/2005 | Diximus | H01Q 21/10 343/790 |
| 9,276,310 | B1 * | 3/2016 | Apel | H01Q 1/362 |

* cited by examiner

COLLINEAR ANTENNA STRUCTURE WITH INDEPENDENT ACCESSES

CROSS-REFERENCE TO RELATED APPLICATIONS

This application is a § 371 national stage entry of International Application No. PCT/FR2018/051559, filed Jun. 26, 2018, which claims priority of French National Application No. FR1755843, filed Jun. 26, 2017, the entire contents of which are incorporated herein by reference.

1. TECHNICAL FIELD OF THE INVENTION

The invention relates to an antenna structure with independent access. In particular, the invention relates to an antenna structure comprising several collinear individual antennas, each powered by an independent access, for transmitting and/or receiving wavelengths of metric frequency (between 30 and 300 MHz) or of decimetric frequency (between 300 and 3000 MHz).

2. TECHNOLOGICAL BACKGROUND

Collinear antenna structures comprise several independent antennas that are used to transmit and/or receive signals in similar or identical frequencies, or in similar, identical or overlapping frequency bands.

To increase the decoupling between the antennas of the antenna structure, thereby reducing interferences between the signals arriving at or leaving the antennas, the current solution is to move the antennas away from one another, which can generate antenna structures with excessive dimensions (of up to several tens of meters for 1 GHz frequencies), owing to the space required between two antennas. This spacing requirement increases as the frequency used diminishes.

A first solution is to position the antennas in a precise manner in order to take full advantage of the radiation troughs of each antenna to maximise the decoupling. However, the positioning of these antennas cannot be achieved easily without degrading their radio performance.

Indeed, the mechanical support of the antenna structures and the grounding are elements that reduce the decoupling between antennas, in particular because of the induced currents. Even if the supports are made of dielectric materials, the transmission lines of each antenna generate the same type of defect.

Another solution is to arrange the antennas according to a horizontal distribution, in which case, to avoid significant coupling of the antennas, the distance between two antennas must be increased, thereby requiring a large ground surface area and significant installation and maintenance costs.

The inventors have therefore sought a solution to these disadvantages.

3. PURPOSES OF THE INVENTION

The purpose of the invention is to remedy at least some of the disadvantages of known antenna structures.

In particular, the invention aims at providing, in at least one of the embodiments of the invention, a collinear antenna structure with independent accesses combining strong decoupling capacities, large gains, and a reduced volume.

The invention also aims at providing, in at least one of its embodiments, a collinear antenna structure with independent accesses enabling a reduced distance between two consecutive antennas, with significant decoupling.

The invention also aims at providing, in at least one embodiment of the invention, a collinear antenna structure with independent accesses that is easy to install and maintain.

The invention also aims at providing, in at least one of its embodiments, a collinear antenna structure with independent accesses that takes up a minimum amount of ground space.

The invention also aims at providing, in at least one of its embodiments, a collinear antenna structure with independent accesses having omnidirectional radiation patterns and symmetrical radiation lobes.

4. PRESENTATION OF THE INVENTION

For this purpose, the invention relates to an antenna structure for transmitting and/or receiving metric or decimetric frequency waves, characterised in that it comprises n collinear antennas, where $n \leq 2$, each antenna comprising a radiating portion comprising a first succession of i coaxial radiating elements about a first axis, alternating with at least an additional succession of i coaxial radiating elements, each additional succession being arranged about an axis that is different from the first axis, where $i \leq 2$, each antenna being independently powered by a coaxial cable at the level of an excitation input, each antenna comprising at least one lower quarter-wave trap arranged between the excitation input and a first end of the radiating portion, and at least one upper quarter-wave trap arranged at a second end of the radiating portion, at least a first antenna comprising at least $n-1$ hollow cores extending over the entire length, said hollow cores forming the axes of the successions of radiating coaxial elements and at least one of the hollow cores being configured to receive a coaxial cable intended to power another antenna collinear with the first antenna, at least an intermediate quarter-wave trap being arranged between two consecutive collinear antennas around a coaxial cable, and a terminal element, arranged at the second end of the radiating portion, after the upper quarter-wave trap, and formed of the hollow core or cores of the antenna.

An antenna structure according to the invention therefore provides significant decoupling with a reduced spacing between antennas, while retaining perfectly omnidirectional patterns. The antenna structure therefore provides for space savings and increased performance, and its visual impact and ground space are significantly reduced. In particular, the upper quarter-wave traps improve on-site radiation (reduction of on-site opening and secondary lobes, in particular) and are conducive to the proper adaptation of the antenna. The lower quarter-wave traps limit the circulation of currents along the bearing structure of the antenna structure (at the level of the excitation input) and along the coaxial cable, also facilitating the reduction of lower secondary lobes.

The term "quarter-wave" describes traps that extend relative to the wavelength at the central operating frequency of the antenna structure.

If an antenna is followed by another antenna, its terminal element is arranged between the upper quarter-wave trap and the intermediate quarter-wave trap. The terminal elements also improve on-site radiation (reduction of on-site opening and secondary lobes, in particular) and are conducive to the proper adaptation of the antenna.

Additional quarter-wave traps significantly reduce the zenith radiation generated by the terminal elements, thereby facilitating the decoupling of the antennas by reducing significantly the surface currents that can travel on the coaxial cable.

Furthermore, the installation of overhead elements is facilitated by the use of a single antenna structure comprising several independent accesses.

The configuration of the antenna structure also preserves the radiation symmetries, in particular at the level of the secondary lobes. In particular, the radiation patterns are omnidirectional and the radiation lobes are symmetrical.

The hollow core or cores wherein the coaxial cable or cables extend further ensures electromagnetic shielding so as not to influence the radiation of the overhead element or elements comprising this core or these cores intersected by the coaxial cables. Thus, the passage of the coaxial cables is radio-electrically transparent.

In the case of elevated decoupling values being required between the antennas (greater than 50 dB), the coaxial cables must feature elevated electromagnetic shielding so as to avoid inter-line coupling at the foot of the antenna structure. Preferably, a double-braided cable or a triple-braided cable is installed in the entire antenna or part thereof, preferably in the lower part of the antenna, at the level of the excitation input.

The antenna structure according to the invention can advantageously be used for the IoT (Internet of Things), or more broadly for any service requiring a significant decoupling of independent antenna systems operating in the same frequency band or in very similar or overlapping frequency bands, in the field of aeronautics for example (civil aviation in particular).

Advantageously and according to the invention, the number i of radiating coaxial elements about each axis ranges from two to four.

According to this aspect of the invention, the number of radiating elements is a compromise between, on one hand, the gain, the opening in the vertical plane, the directivity, and the decoupling which increases with the number of radiating elements, and, on the other hand, the size of the antenna which becomes too big when the number of radiating elements increases, as well as the formation of secondary lobes caused by the networking of the radiating elements that can reduce decoupling.

Furthermore, the use of a coaxial cable to power each antenna after the first antenna causes losses in the coaxial cable, thereby reducing the gain of the antennas. Thus, if the antennas are required to have the same gain, for specific applications, it is for example possible to add a coaxial cable with the same length as the first antenna, or to increase the number of radiating elements in the antenna or antennas following the first antenna.

Advantageously and according to the invention, each upper quarter-wave trap, each lower quarter-wave trap and each intermediate quarter-wave trap is intersected by a hollow core.

According to this aspect of the invention, the quarter-wave traps operate by limiting the radiation of the hollow cores, in particularly due to the coaxial cable that intersects with these, when applicable.

Advantageously and according to invention, the structure comprises n collinear antennas, n being >2, and each collinear antenna comprises at least n-x hollow cores extending over its entire length, the hollow cores being configured to receive a coaxial cable intended to power another antenna that is collinear with said antenna, with x being the number of antennas opposite the excitation input of said antenna on the antenna structure.

Preferably, the antenna structure comprises from two to five antennas (i.e. $2 \geq n \geq 5$).

Advantageously and according to the invention, each terminal element comprises a short-circuit element connecting two hollow cores of the antenna to which it belongs.

According to this aspect of the invention, the short-circuit element can serve different purposes depending on the antenna on which it is located.

On an antenna followed by another antenna, is used a single intermediate quarter-wave trap to reduce the zenith radiation of the antenna and to limit to a minimum the surface currents on the extension of the side core comprising the coaxial cable.

On the last antenna of the antenna structure, i.e. the antenna the most distant from the excitation input of the first antenna, the short-circuit element provides an additional degree of freedom for the adjustment of the antenna, by enabling in particular the optimisation of the upper secondary lobes, and more moderately the on-site reduction of the opening at half power and the directivity of the antenna.

Advantageously and according to the invention, each lower quarter-wave trap comprises two collinear cylindrical quarter-wave sub-traps with identical dimensions and spaced by a radius of the quarter-wave sub-traps.

Advantageously and according to the invention, each upper quarter-wave trap comprises two parallel cylindrical quarter-wave sub-traps with identical dimensions.

Advantageously and according to the invention, between each antenna, the antenna structure comprises at least one device for the blocking of sheath currents arranged on each coaxial cable.

According to this aspect of the invention, the current blocking device limits the circulation of sheath currents travelling through the sheath of each coaxial cable and that are able, by coupling, to find themselves on the terminal element.

The invention also relates to an antenna structure characterised in combination by all or part of the characteristics mentioned above or below.

5. LIST OF FIGURES

Other purposes, characteristics and advantages of this invention are revealed upon reading the following description, provided by way of example and not limited thereto, and with reference to the appended drawings, in which:

FIG. 1 is a schematic and perspective view of an antenna structure according to a first embodiment of the invention, FIG. 2 is a schematic and cross-section view of a first detail of an antenna structure according to the first embodiment of the invention, FIG. 3 is a schematic and cross-section view of a second detail of an antenna structure according to the first embodiment of the invention, FIG. 4 is a schematic and cross-section view of a third detail of an antenna structure according to the first embodiment of the invention, FIG. 5 is a schematic and perspective view of an antenna structure according to a second embodiment of the invention, FIG. 6 is a schematic and perspective view of an antenna structure according to a third embodiment of the invention, FIG. 7 is a schematic and perspective view of an antenna structure according to a fourth embodiment of the invention, FIG. 8 is a schematic and perspective view of an antenna structure according to a fifth embodiment of the invention, FIG. 9 is a unitary radiation pattern in the vertical plane of an antenna structure according to an embodiment of the invention, FIG. 10 is a graph showing the decoupling of the antennas and the impedance matching achieved with an antenna structure according to the first embodiment of the invention, FIG. 11 is a graph showing the decoupling of the antennas and the impedance matching achieved with an antenna structure according to the second embodiment.

6. DETAILED DESCRIPTION OF AN EMBODIMENT OF THE INVENTION

The following embodiments are provided by way of examples. Although the description makes reference to one or several embodiments, this doesn't necessarily mean that each reference is made to the same embodiment, or that the characteristics thereof apply only to one embodiment. Individual characteristics of different embodiments can also be combined to provide other embodiments. In the figures, the scales and proportions are not strictly respected for purposes of clarity and illustration.

FIGS. 1 to 8 show antenna structures or portions of antenna structures in which powering of the antenna structures is performed at the level of an excitation input located in the top right corner of the figure, the first antenna being located on the side of this excitation input, and the following antennas being arranged consecutively from the top right corner to the bottom left corner, until reaching the last antenna located in the bottom left corner. This orientation, provided for illustrative purposes and for added clarity, does not preclude other arrangements of the antenna structure when it is used in a real environment, which can vary according to the required application. In particular, the antenna structure is generally arranged with the excitation input at ground level and extending vertically upwards.

FIG. 1 shows schematically an antenna structure according to a first embodiment of the invention. The antenna structure comprises a first antenna 10, and a second antenna 20, both antennas being collinear and powered independently.

Each antenna comprising a radiating portion comprising a first succession of radiating elements about a first axis (referenced 12*i* for the first antenna 10 and 22*i* for the second antenna 20), alternating with at least an additional succession of coaxial radiating elements arranged about at least a second axis, in this case two additional successions arranged about two axes. Thus, the two additional successions comprise two radiating elements arranged side-by-side (referenced 11*i* for the first antenna 10, and 21*i* for the second antenna 20) and alternating with the first succession of coaxial radiating elements.

Each antenna comprises an excitation input (referenced 16 for the first antenna 10 and 26 for the second antenna 20) enabling the powering of the antenna by a coaxial cable. Between the excitation input and the radiating portion, a quarter-wave trap is arranged, termed lower quarter-wave trap (referenced 15 for the first antenna 10 and 25 for the second antenna 20). In this embodiment, each quarter-wave trap comprises two quarter-wave sub-traps (respectively two quarter-wave sub-traps $\mathbf{15}_1$ and $\mathbf{15}_2$ for the lower quarter wave trap 15 of the first antenna 10 and two quarter-wave traps $\mathbf{25}_1$ and $\mathbf{25}_2$ for the lower quarter-wave trap 25 of the second antenna 20). The spacing between the lower quarter-wave trap 15 and the first radiating element 111 must have a length that is shorter by 20% to 30% than that of the radiating elements.

At the level of a second end of the radiating portion of each antenna, i.e. at the end the furthest away from the power input, each antenna comprises an upper quarter-wave trap (referenced 14 for the first antenna 10 and 24 for the second antenna 20).

At the second end of each antenna, after the upper quarter-wave trap, each antenna comprises a terminal element (referenced 13 for the first antenna 10 and 23 for the second antenna 20) formed by the extension of at least one hollow core, in this case of two hollow cores described below.

Finally, between two antennas, the coaxial power cable 17 exits the terminal element 13 of the first antenna 10 and connects to the excitation input 26 of the second antenna 20. Between these two antennas, the coaxial cable is surrounded by an intermediate quarter-wave trap 131, located in the extension of the terminal element 13 and in which the coaxial power cable 17 passes. Furthermore, between the intermediate quarter-wave trap 131 and the excitation input 26 of the second antenna 20, the antenna structure preferably comprises at least one device for blocking the sheath current, in this case a sheath current blocking device 18.

FIGS. 2, 3 and 4 show schematically cross-section views respectively of a first, a second and a third detail of the first antenna of an antenna structure according to the first embodiment of the invention. The descriptions of elements with reference to these FIGS. 2-4 are also applicable to identical elements of the second antenna of the antenna structure.

In this embodiment of the invention, the radiating elements are hollow cylindrical elements arranged about an axis formed by a core. The cores can be solid or hollow and are conductive. In particular, with n being the number of antennas of the structure, at least n−1 cores of the first antenna are hollow and receive a power cable intended for a subsequent antenna in the antenna structure. In this embodiment, the cores 191 and 190 forming the axes of additional successions of radiating elements, termed side cores, are hollow and one of the cores 191 comprises the power cable 17 of the second antenna 20. The coaxial cable thus passes inside radiating elements, quarter-wave traps and the terminal element, as shown in the figures. The central core forming the axis of the first succession of radiating elements and enabling the powering of the antenna is made of a solid part 163 and of a hollow part 162, surrounded by a conductive cylindrical element 161. The central core matches the impedance of the antenna to the impedance that is suitable for the considered frequency. The second antenna 20, even if it does not require a hollow core, as it is not intersected by any power cables, can also feature the same structure comprising hollow cores. The part 163 is an impedance adjustment element. According to other embodiments, the part 163 can also be hollow. According to other embodiments, the part 163 is not present and the antenna is connected to the hollow part 162.

FIG. 2 shows a first detail of the first antenna 10 at the level of the power input 16, at the first end of the first antenna of the antenna structure. The sub-traps $\mathbf{15}_1$ and $\mathbf{15}_2$ have a cylindrical shape, each with a hollow conductive cylindrical contour (respectively referenced $\mathbf{151}_1$ and $\mathbf{151}_2$), a solid conductive base (respectively referenced $\mathbf{152}_1$ and $\mathbf{152}_2$), and a hollow base opposite the solid base. Dielectric centring washers (respectively referenced $\mathbf{153}_1$ and $\mathbf{153}_2$) are here arranged in the hollow base to provide mechanical reinforcement of the quarter-wave sub-traps. By varying the thickness and material of these dielectric washers, it is also possible to adjust the electrical length of the sub-traps. In other embodiments, the sub-traps do not comprise dielectric centring washers.

The solid bases provide an electrical contact with a sheath of the coaxial cable, either directly or through the side core 191. Furthermore, they have orifices (not shown) for the passage of the side cores 190 and 191.

In this case, the coaxial cable is inside the side core 191 that passes inside the sub-traps, but if the quarter-wave sub-traps have a sufficiently wide diameter, the coaxial cable can be secured at the contact point with the cylindrical contour.

FIG. 3 shows a second detail of the first antenna 10 at the level of the terminal element 13, at the second end of the first antenna of the antenna structure.

The terminal element 13 is formed by the side cores 190 and 191 extending parallel after their passage in the upper quarter-wave trap 14. In this embodiment, the terminal element comprises a hollow short-circuit element 192 connecting the two side cores 190 and 191 and extending, in this embodiment, perpendicular to said side cores 190 and 191. In this case, the short-circuit element 192 is a structural extension of the side core 190 and connects to the side core 191. According to other embodiments, the short-circuit element 192 is not necessarily perpendicular to the side cores.

Between the terminal element 13 and the radiating part of the first antenna 10, the first antenna comprises an upper quarter-wave trap 14, here comprising two sub-traps 140 and 141 arranged parallel with one another. The sub-traps 140 and 141 have, as their axis, the side cores respectively 190 and 191. The sub-traps 140 and 141 are formed of hollow cylindrical elements, each being closed at its base closest to the terminal element 13 by a conductive annular element, respectively referenced 142 and 143, forming a short-circuit of the sub-traps 140 and 141. The conductive annular elements 142 and 143 are arranged on the antenna at a distance from one another shorter than or equal to a quarter-wave at the central operating frequency with respect to the side cores 190 and 191. To provide the mechanical rigidity of the sub-traps 140 and 141, each of the latter can comprise, similarly to the lower sub-traps, a dielectric centring washer (respectively referenced 144 and 145) arranged at the level of the base of the cylindrical element located opposite the cylindrical element comprising the conductive annular element.

Between the first antenna 10 and the second antenna 20, and more generally in other embodiments between each consecutive antenna, the antenna structure comprises an intermediate quarter-wave trap 131, in this case cylindrical and featuring a structure similar to that of the lower quarter-wave traps. The side core 191 comprising the coaxial cable 17 extends beyond the terminal element 13, thereby forming an extension 194, which is preferably collinear with the axis of the central core of the antennas. The intermediate quarter-wave trap 131 surrounds the coaxial cable 17 at the level of this extension 194. The extension 194 ends after the quarter-wave trap 131 and the coaxial cable 17 comes out of the extension and is arranged so as to be connected to the subsequent antenna, in this case the second antenna 20. The dimensions of the intermediate quarter-wave trap are such that the sum of its radius and of its length is smaller than or equal to a quarter of the wavelength associated with the central operating frequency.

In embodiments comprising more than two antennas and therefore at least two coaxial cables passing through the first antenna, there are as many intermediate quarter-wave traps as there are coaxial cables leaving the antenna to power a subsequent antenna.

A device 18 for blocking the sheath current can be attached to the coaxial cable 17. This blocking device 18 can be made of one or several wired or L-shaped quarter-wave traps, or one or several blocking ferrite elements with an impedance that is as elevated as possible at the operating frequency of the system. Ferrite elements are preferably used when the section of the coaxial cable is reduced. The section of a bare coaxial cable 17 between the intermediate quarter-wave trap 131 and the blocking device 18 must be small relative to the operating wavelength (typically of less than one sixth of the wavelength at the lowest operating frequency).

After this blocking device 18, the coaxial cable 17 is connected to the second antenna at the level of its excitation input 26, in particular by means of a connection element 264 of the sheath of the coaxial cable 17 to the conductive cylindrical element 261 and a connection element 265 of the central conductor of the coaxial cable 17 to the solid part 263 of the side core. These connection elements 264 and 265 are sized to ensure the continuity of the characteristic impedance between the coaxial cable 17 and the excitation input 26. In particular, the connection elements can have a frusto-conical shape with dimensions adapted to the characteristic impedance of the antenna or, if the impedance of the antenna is a standard impedance of the 50Ω-type, a shape suited to the diameter of the coaxial cable 17. Preferably, the distance between the terminal element of the preceding antenna and the excitation input of the subsequent antenna must be greater than a third of the operating wavelength.

FIG. 4 shows a third detail of the first antenna 10 at the level of the radiating portion.

The first succession of radiating elements is made of radiating elements 12*i* comprising a conductive hollow cylinder 120 positioned coaxially with the central core 162 (thereby locally contributing to radiation on the length of the cylinder 120). Spacing between the cylinder 120 and the central core is provided by dielectric centring annular elements 112.

Additional successions of radiating elements comprise the radiating elements 11*i*. A first additional succession of radiating element is formed by conductive hollow cylinders 110 positioned about an axis formed by the side core 190. A second additional succession of radiating elements is formed by conductive hollow cylinders 111 positioned about an axis formed by the side core 191. The side cores 190 and 191 thereby contribute locally to radiation on the length of the cylinders. Spacing between the cylinders 110 and 111 and their respective side cores 190 and 191 is provided by centring dielectric centring annular elements 112.

The relative permittivity of the centring element 112 changes the guided length of the coaxial sections: thus, the thickness and the relative permittivity of these centring elements 112 directly influence the length of the radiating elements 11*i*. The length of the latter is therefore close to half the guided effective wavelength λG at the central operating frequency (in particular from 0.43 λG to 0.5 λG).

In order to ensure the electric continuity of the antenna and the series powering of the subsequent radiating elements, the cylinders 110 and 111 are electrically connected, ideally over their entire lengths, to the central core 162.

Preferably, the lengths of the cylinders 110, 111 and 120 are identical. Regarding the second antenna or, more generally, a subsequent antenna, the length of the preceding cylinders on these other antennas can be reduced (generally by less than 5%) with respect to their length on the first antenna, in order to reduce the secondary lobes downwards.

FIG. 5 shows schematically a perspective view of an antenna structure according to a second embodiment of the invention. This embodiment is identical to the first embodiment of the invention, with the exception that the extension 194 is longer (over several operating wavelengths) in order to increase the decoupling between the two antennas (decoupling greater than 50 dB). This implies that the blocking device 18 is made of a plurality of blocking sub-devices. The blocking sub-devices are separated into two groups, a first group $\mathbf{18}_1$ of blocking sub-devices 180 formed of cylindrical elements of the quarter-wave trap-type, of which the short-circuits connecting them to the coaxial cable 17 are arranged on the side of the second antenna 20, and a second group 182 of blocking sub-devices 181 formed of cylindrical elements of the quarter-wave trap-type, of which the short-circuits connecting them to the coaxial cable 17 are arranged on the side of the first antenna 10.

The maximum spacing between the blocking sub-devices is a third of the relative wavelength at the central operating frequency.

FIG. 6 shows schematically a perspective view of an antenna structure according to a third embodiment of the invention. In this embodiment, the antenna structure comprises three antennas, a first antenna 10, a second antenna 20 and a third antenna 30. The operating principle and the elements described for an antenna structure with two antennas, with reference to FIGS. 1 to 4, apply to this antenna structure with four antennas.

As described above, each antenna comprises an excitation input (respectively referenced 16, 26 and 36 for the first, second and third antenna), a lower quarter-wave trap (respectively referenced 15, 25 and 35 for the first, second and third antenna), a first succession of radiating elements (referenced $\mathbf{12}_1$ and $\mathbf{12}_2$ for the first antenna 10, $\mathbf{22}_1$ and $\mathbf{22}_2$ for the second antenna 20, and $\mathbf{32}_1$ and $\mathbf{32}_2$ for the third antenna 30), two additional successions of radiating elements (referenced $\mathbf{11}_1$ and $\mathbf{11}_2$ for the first antenna 10, $\mathbf{21}_1$ and $\mathbf{21}_2$ for the second antenna 20, and $\mathbf{31}_1$ and $\mathbf{31}_2$ for the third antenna 30), an upper quarter-wave trap (respectively referenced 14, 24 and 34 for the first, second and third antenna), a terminal element (respectively referenced 13, 23 and 33 for the first, second and third antenna), and two intermediate quarter-wave traps, a first intermediate quarter-wave trap 131 between the first antenna 10 and the second antenna 20 (comprising two sub-traps, one for each coaxial cable running from the first antenna to the second antenna), and a second intermediate quarter-wave trap 231 between the second antenna 20 and the third antenna 30.

The coaxial cable 17 powering the second antenna 20 passes through the first antenna 10 in one of its hollow cores, for example the side core 191 as described above. For the third antenna, a coaxial power cable 27 passes through the first antenna 10 in another hollow core, for example the side core 190 described above, and through the second antenna 20 by means of a hollow core.

FIG. 7 shows schematically a perspective view of an antenna structure according to a fourth embodiment of the invention. Based on the antenna structures described above and changing the number of additional successions of radiating elements, it is possible to achieve a plurality of hollow cores through which the coaxial power cables of subsequent antennas can pass. Thus, in this embodiment, the antenna structure comprises five antennas, a first antenna 10 comprising a first succession of radiating elements $\mathbf{12}_1$, $\mathbf{12}_2$ and four additional successions of radiating elements $\mathbf{11}_1$,$\mathbf{11}_2$ (i.e. four radiating elements side-by-side about four axes formed by at least four hollow cores for the passage of the coaxial cables for the four subsequent antennas), a second antenna 20 comprising a first succession of radiating elements $\mathbf{22}_1$, $\mathbf{22}_2$ and four additional successions of radiating elements $\mathbf{21}_1$,$\mathbf{21}_2$ (i.e. four radiating elements side-by-side about four axes formed by four hollow cores, of which at least three hollow cores are used for the passage of the coaxial cables for the three subsequent antennas), a third antenna 30 comprising a first succession of radiating elements $\mathbf{32}_1$, $\mathbf{32}_2$ and four additional successions of radiating elements $\mathbf{31}_1$,$\mathbf{31}_2$ (i.e. four radiating elements side-by-side about four axes formed by four hollow cores, of which at least two hollow cores are used for the passage of the coaxial cables for the two subsequent antennas), a fourth antenna 40 comprising a first succession of radiating elements $\mathbf{42}_1$, $\mathbf{42}_2$ and four additional successions of radiating elements $\mathbf{41}_1$, $\mathbf{41}_2$ (i.e. four radiating elements side-by-side about four axes formed by four hollow cores, of which at least one hollow core is used for the passage of the coaxial cables for the subsequent antenna), and a fifth antenna 50 comprising a first succession of radiating elements $\mathbf{52}_1$, $\mathbf{52}_2$ and four additional successions of radiating elements $\mathbf{51}_1$,$\mathbf{51}_2$ (i.e. four radiating elements side-by-side about four axes formed by four cores that can be hollow or solid).

In a third alternative embodiment, as the second, third, fourth and fifth antennas do not require four hollow cores for the passage of four coaxial cables, the number of additional successions of radiating elements can be reduced to correspond to the number of necessary hollow cores. In particular, the third, fourth and fifth antennas can have the shape of the antennas described above for the third embodiment provided with reference to FIG. 6.

FIG. 8 schematically shows a perspective view of an antenna structure according to a fifth embodiment of the invention. In this simplified embodiment of an antenna structure comprising a first antenna 10 and a second antenna 20, each antenna comprises, in addition to the first succession of radiating elements ($\mathbf{12}_1$ and $\mathbf{12}_2$ for the first antenna 10, and $\mathbf{22}_1$ and $\mathbf{22}_2$ for the second antenna 20), a single additional succession of radiating elements ($\mathbf{11}_1$ and $\mathbf{11}_2$ for the first antenna 10, and $\mathbf{21}_1$ and $\mathbf{21}_2$ for the second antenna 20), i.e. made of a radiating element about an axis, in particular a hollow core for the passage of a coaxial cable.

This antenna structure is mechanically simpler but has a very slight omnidirectionality defect (of less than 1 dB) and an asymmetry of the side lobes.

FIG. 9 is a unitary radiation diagram in the vertical plane of an antenna structure according to an embodiment of the invention, in solid lines for the upper antenna (the last antenna of the antenna structure) and in dotted lines for the first antenna of the antenna structure. A strong reduction of the secondary lobes, which cause antenna decoupling problems, is noted, i.e. of the downwards secondary lobes for the upper antenna and the upwards secondary lobes for the lower antenna, in particular due to the adjustment of the lengths of the cylinders of the radiating elements according to the antennas.

Figure 1:
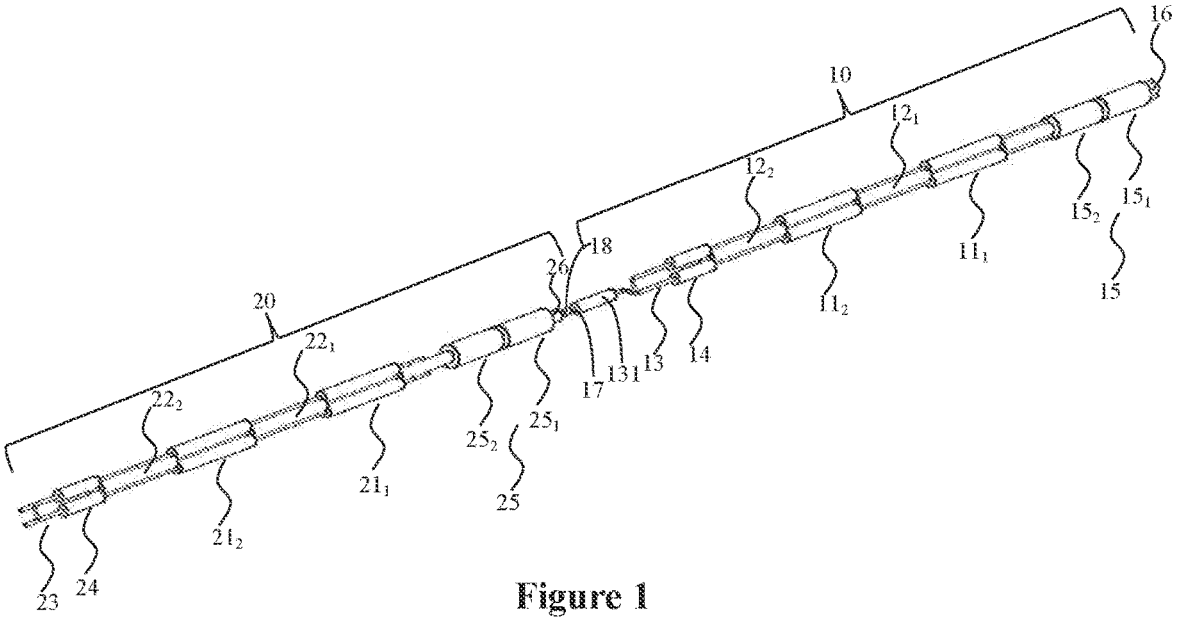
Figure 2:
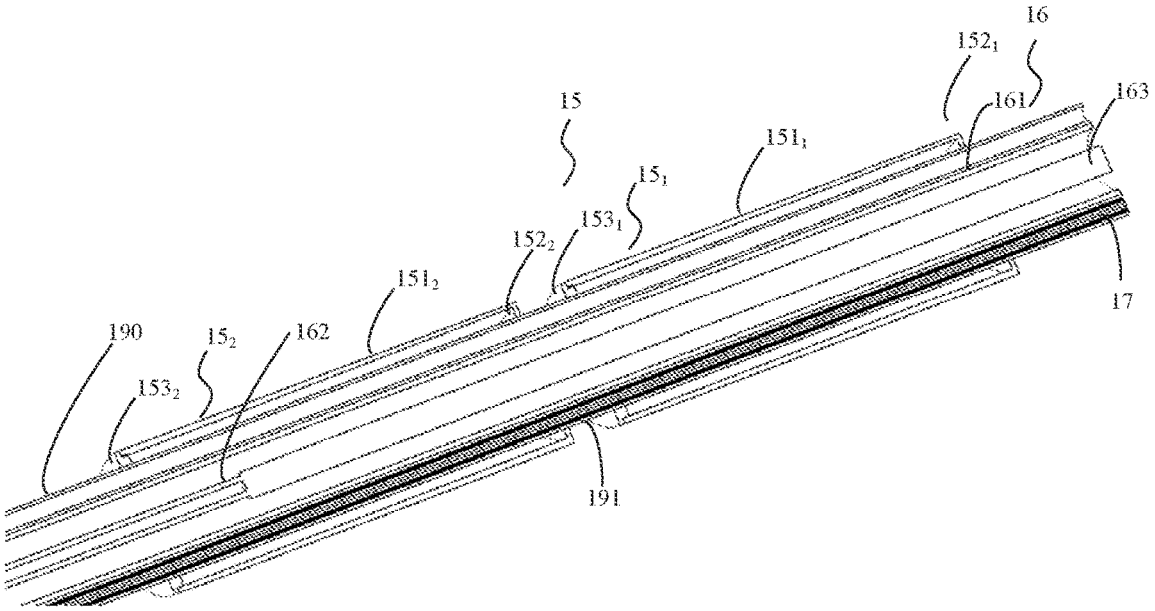
Figure 3:
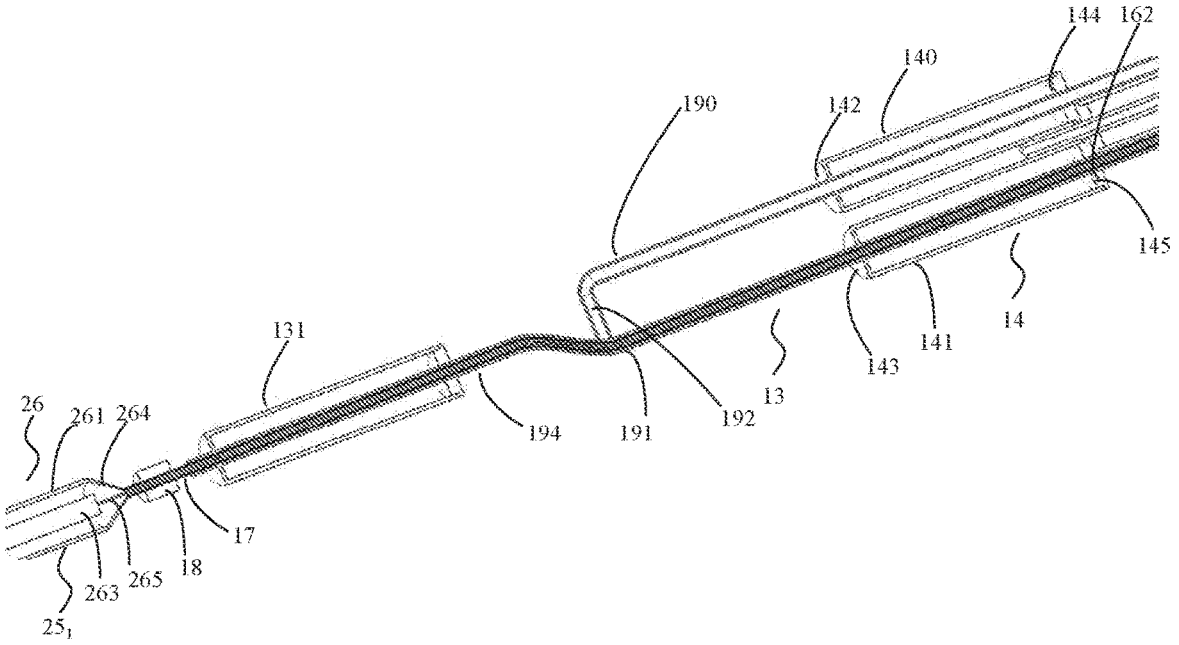
Figure 4:
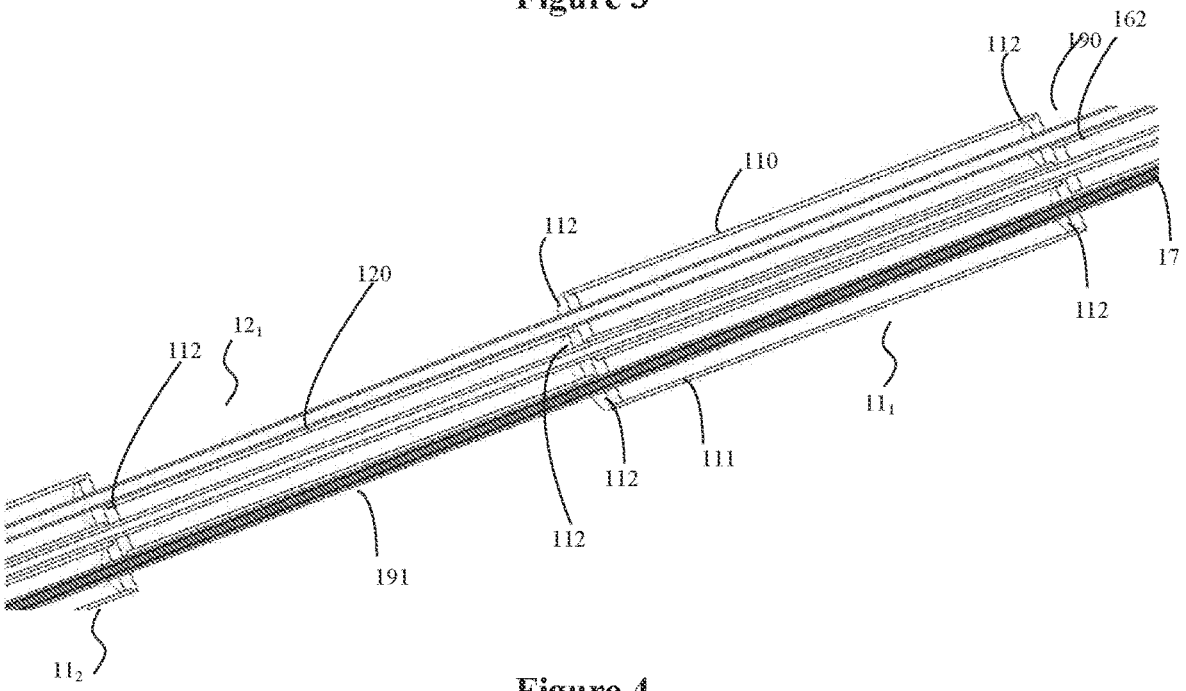
Figure 5:
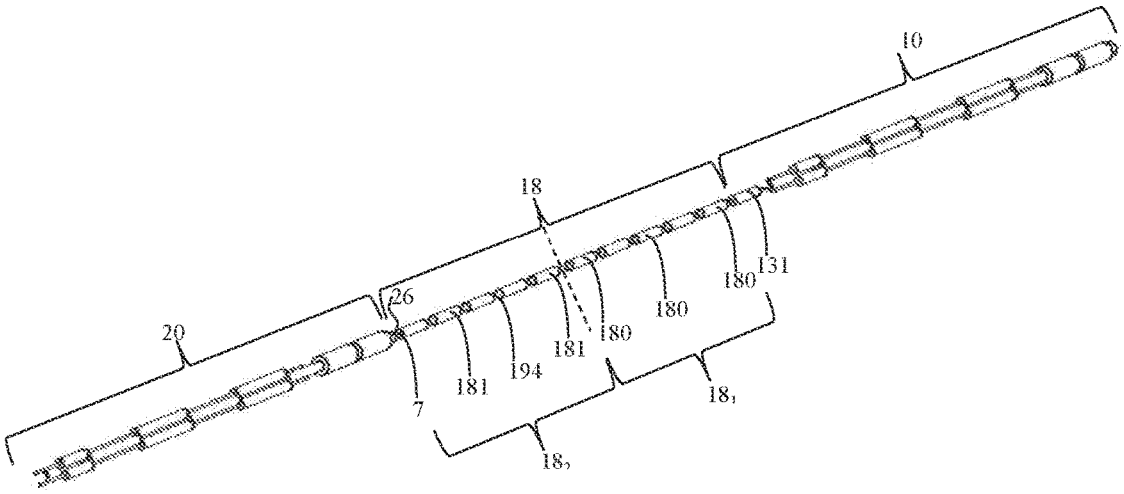
Figure 6:
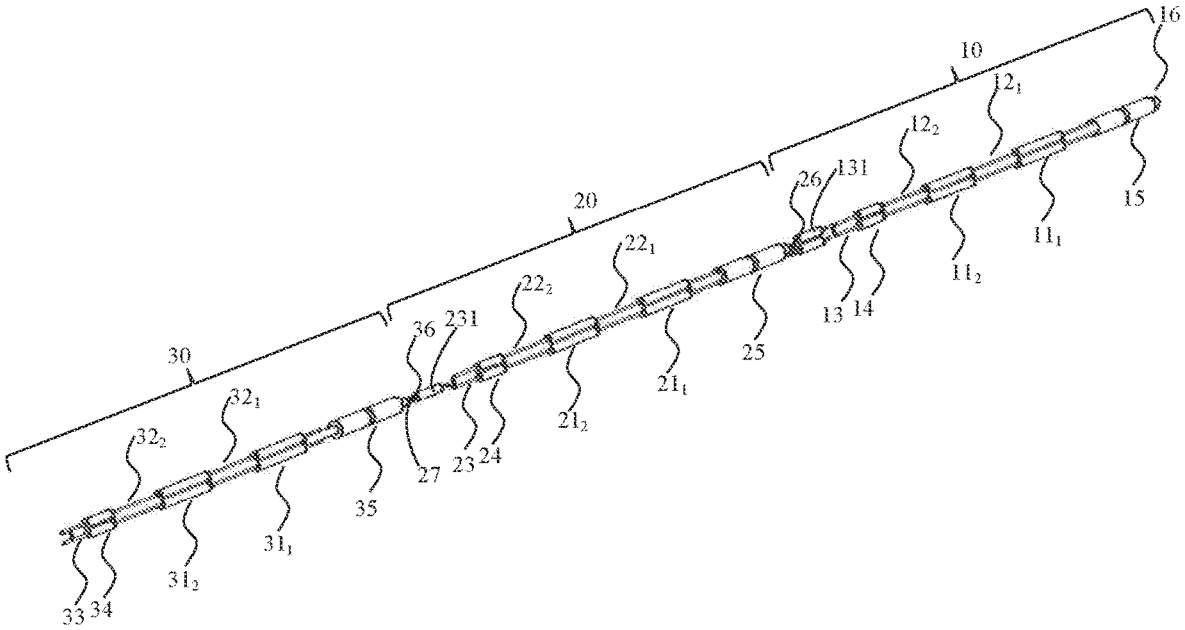
Figure 7:
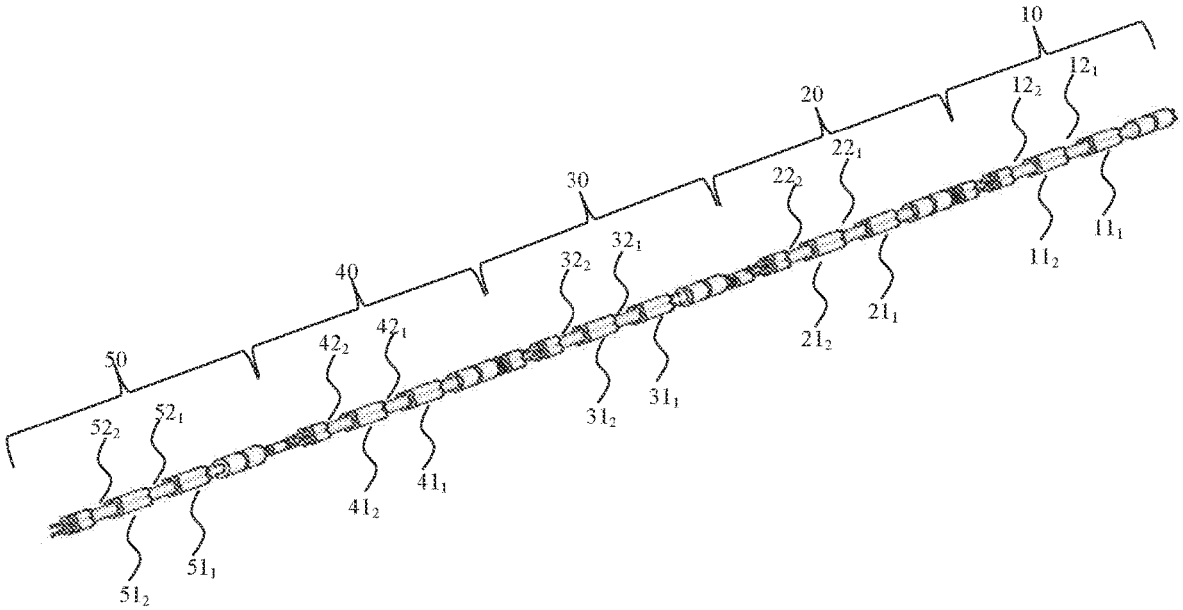
Figure 8:
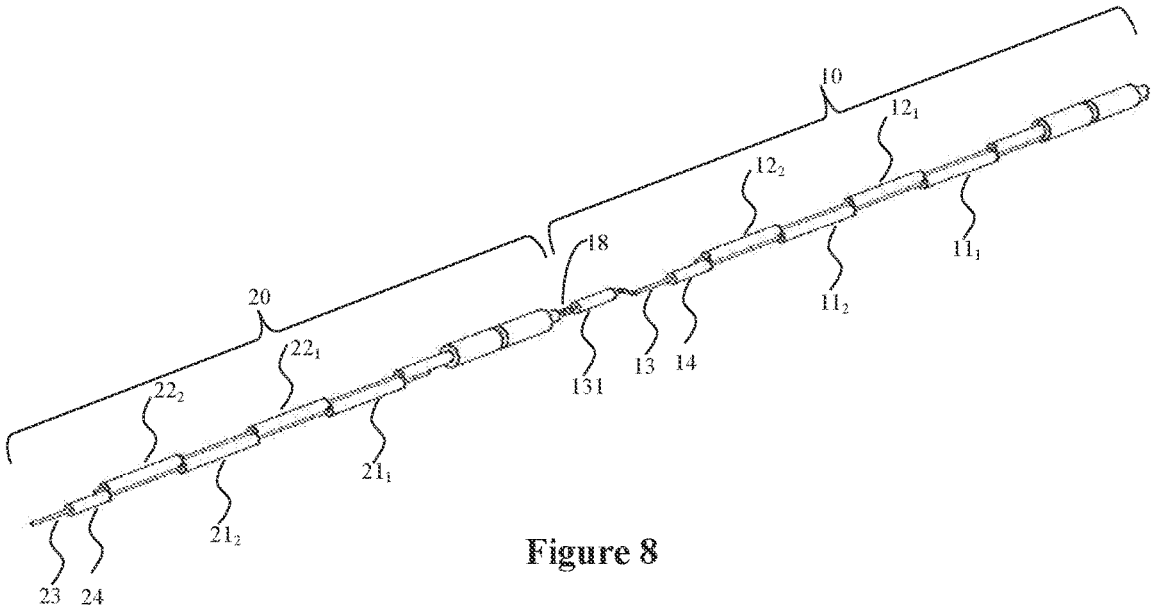
Figure 9:
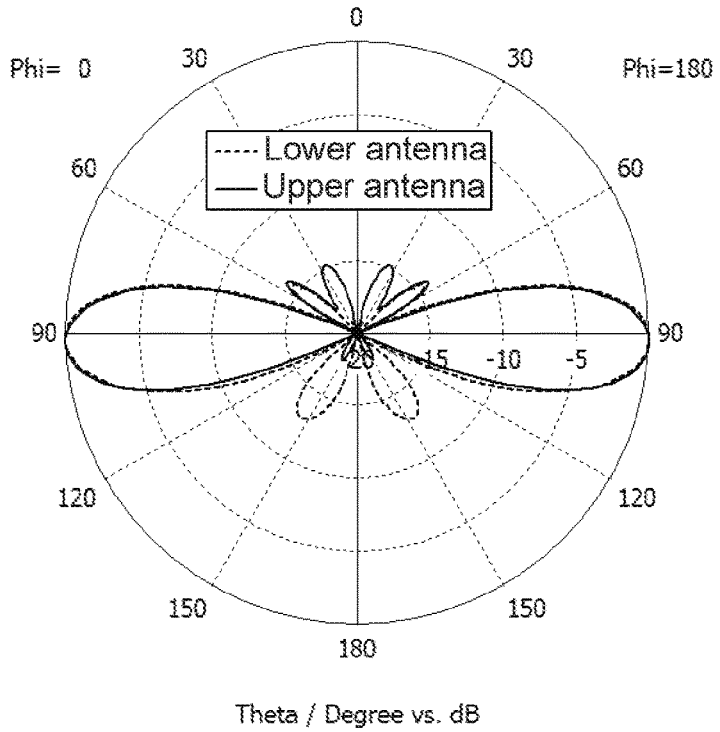
Figure 10:
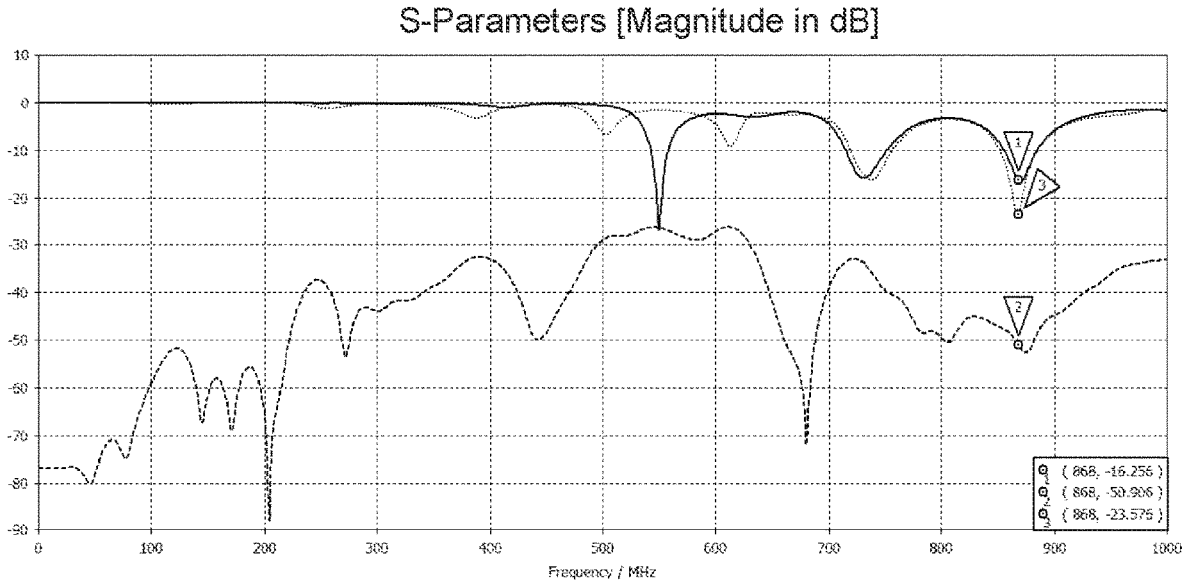
FIG. 10 is a graph showing the decoupling of the antennas and the impedance matching achieved with an antenna structure according to the first embodiment of the invention, expressed in dB with respect to the operating frequency.
Figure 11:
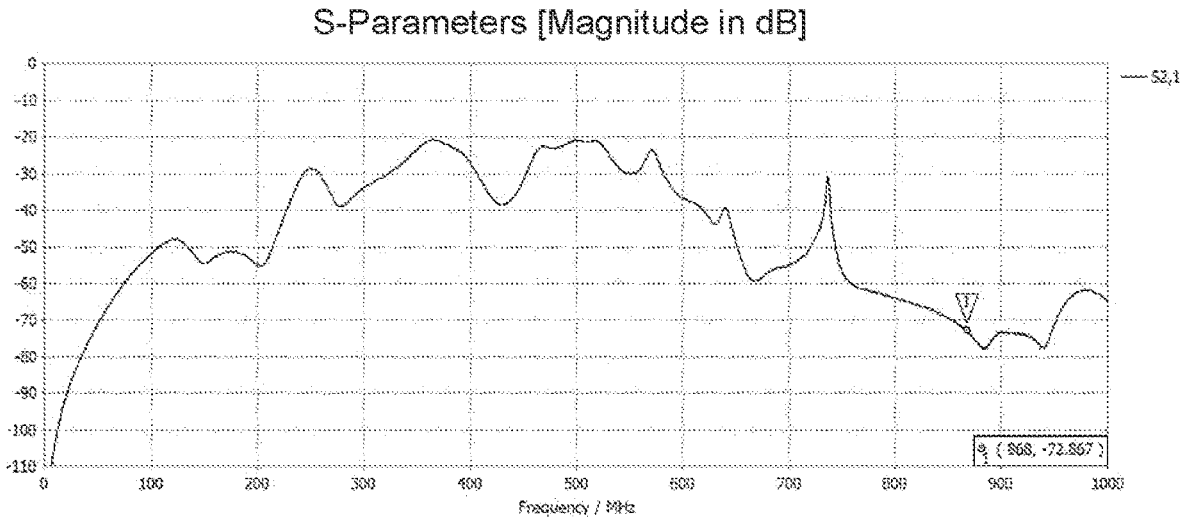
FIG. 11 is a graph showing the decoupling of the antennas and the impedance matching achieved with an antenna structure according to the second embodiment of the invention, expressed in dB with respect to the operating frequency.

The invention is not limited to embodiments described above.

In particular, the antenna structures can be surrounded by a radome that is not shown in the figures for purposes of clarity. Radomes are dielectric structures made of fibreglass, sealing the antenna structure and slightly modifying the radiation characteristics of the latter according to the relative permittivity and the dielectric losses of the radome.

Furthermore, a mechanical support device can be provided to support the upper antennas. The latter is made of dielectric elements with reduced permittivity fitted, at their upper part, on the excitation baseplates and, at their lower part, on the terminal radiating elements.

The dimensions of the described elements can vary from those shown in the figures. In particular, the dimensions of the upper, lower and intermediate quarter-wave traps and of the terminal element can be amended based on the required performance, in particular in terms of matching, gain, on-site opening of the diagram, minimising the upper or lower secondary lobes, etc. The dimensions can also change within a given antenna structure, from one antenna to the other, although it is important to ensure the same radio characteristics are maintained. In any case, for each antenna, the upper quarter-wave traps and the terminal elements must have a length that is shorter than or equal to the quarter-wave of the central operating frequency and the terminal element must have a length that is shorter than or equal to the upper quarter-wave trap.

The invention claimed is:

1. Antenna structure for transmitting and/or receiving metric or decimetric frequency waves, comprising n collinear antennas, where n≤2, each antenna comprising a radiating portion comprising a first succession of i coaxial radiating elements about a first axis, alternating with at least an additional succession of i coaxial radiating elements, each additional succession being arranged about an axis that is different from the first axis, where i≤2, each antenna being independently powered by a coaxial cable at the level of an excitation input, each antenna comprising at least one lower quarter-wave trap arranged between the excitation input and a first end of the radiating portion, and at least one upper quarter-wave trap arranged at a second end of the radiating portion, at least a first antenna comprising at least n−1 hollow cores extending over the entire length, said hollow cores forming the axes of the successions of coaxial radiating elements and at least one of the hollow cores being configured to receive a coaxial cable intended to power another antenna that is collinear with the first antenna, at least an intermediate quarter-wave trap being arranged between two consecutive collinear antennas around a coaxial cable, and a terminal element, arranged at the second end of the radiating portion, after the upper quarter-wave trap, and formed of the hollow core or cores of the antenna.

2. Antenna structure according to claim 1, wherein the number i of coaxial radiating elements about each axis ranges from two to four.

3. Antenna structure according to claim 1, wherein each upper quarter-wave trap, each lower quarter-wave trap and each intermediate quarter-wave trap is intersected by a hollow core.

4. Antenna structure according to claim 1, comprising n collinear antennas, n>2, and each collinear antenna comprises at least n-x hollow cores extending over its entire length, the hollow cores being configured to receive a coaxial cable intended to power another antenna that is collinear with said antenna, with x being the number of antennas opposite the excitation input of said antenna on the antenna structure.

5. Antenna structure according to claim 1, wherein each terminal element comprises a short-circuit element connecting two hollow cores of the antenna to which it belongs.

6. Antenna structure according to claim 1, wherein each lower quarter-wave trap comprises two collinear cylindrical quarter-wave sub-traps with identical dimensions and spaced by a radius of the quarter-wave sub-traps.

7. Antenna structure according to claim 1, wherein each upper quarter-wave trap comprises two parallel cylindrical quarter-wave sub-traps with identical dimensions.

8. Antenna structure according to claim 1, wherein between each antenna, the antenna structure comprises at least one device for the blocking of sheath currents arranged on each coaxial cable.

* * * * *